US010396482B2

(12) United States Patent
Glick et al.

(10) Patent No.: US 10,396,482 B2
(45) Date of Patent: Aug. 27, 2019

(54) ELECTRICAL TERMINAL ASSEMBLY WITH LOCKED SPRING MEMBER

(71) Applicant: Lear Corporation, Southfield, MI (US)

(72) Inventors: Michael Glick, Farmington Hills, MI (US); Deborah Probert, Farmington Hills, MI (US); David Menzies, Linden, MI (US); Michael James Porter, Traverse City, MI (US)

(73) Assignee: Lear Corporation, Southfield, MI (US)

( * ) Notice: Subject to any disclaimer, the term of this patent is extended or adjusted under 35 U.S.C. 154(b) by 17 days.

(21) Appl. No.: 15/848,513

(22) Filed: Dec. 20, 2017

(65) Prior Publication Data

US 2019/0190178 A1 Jun. 20, 2019

(51) Int. Cl.
*H01R 4/48* (2006.01)
*H01R 13/08* (2006.01)
*H01R 43/16* (2006.01)

(52) U.S. Cl.
CPC ..... *H01R 13/08* (2013.01); *H01R 43/16* (2013.01)

(58) Field of Classification Search
CPC ..... H01R 13/18; H01R 13/112; H01R 13/68; H01R 85/202
USPC ..... 439/839, 857, 620.26, 250
See application file for complete search history.

(56) References Cited

U.S. PATENT DOCUMENTS 5,338,229 A 8/1994 Egenolf
5,360,356 A 11/1994 May et al.
5,362,262 A 11/1994 Hotea
5,634,825 A 6/1997 Maki
5,685,746 A 11/1997 Maejima
5,921,821 A 7/1999 Oka et al.
6,997,721 B2 2/2006 Shirota
7,766,706 B2 8/2010 Kawamura et al.
7,892,050 B2 2/2011 Pavlovic et al.
8,366,497 B2 2/2013 Glick et al.
9,142,902 B2 9/2015 Glick et al.
9,190,756 B2 11/2015 Glick et al.
9,190,759 B2 11/2015 Balcerak et al.
9,548,553 B2 1/2017 Glick et al.
2014/0273659 A1 9/2014 Glick et al.

FOREIGN PATENT DOCUMENTS

CN 101286601 A 10/2008
CN 104037523 A 9/2014

*Primary Examiner* — Phuong Chi T Nguyen

(74) *Attorney, Agent, or Firm* — MacMillan, Sobanski & Todd, LLC

(57) ABSTRACT

An electrical terminal assembly includes a contact member. The contact member includes a contact base. A plurality of contact arms extend from the contact base in an arm direction. The contact arms are arranged on opposed sides of a terminal plane. The electrical terminal assembly also includes a spring member. The spring member is supported on the contact member. The spring member includes a spring base. A plurality of spring arms extend from the spring base in the arm direction. The spring arms include respective spring contacts where the spring arms engage one of the contact arms. The spring arms include respective spring deflections between the spring base and the spring contact. Each spring deflection extends into a spring space between adjacent ones of the contact arms.

12 Claims, 6 Drawing Sheets

ELECTRICAL TERMINAL ASSEMBLY WITH LOCKED SPRING MEMBER

BACKGROUND OF THE INVENTION

This invention relates in general to an electrical terminal assembly. More specifically, this invention relates to an electrical terminal assembly that includes a spring member positioned and locked on a contact member.

Electrical terminals commonly include a female terminal and a corresponding male terminal that may be mated to establish an electrical connection. Male electrical terminals are manufactured in various shapes, including pins and blades, and female electrical terminals are manufactured in complementary shapes that can engage the corresponding male terminals. Female terminals often include a contact portion with multiple contact arms that press onto sides of the male terminal. It is known to provide a female terminal with a spring member to increase the compression force between the male terminal and the female terminal. An example of one such spring is shown in U.S. Pat. No. 7,892,050. The spring member is typically made of a material that, compared to the material of the contact portion, has inferior electrical conductivity but is less susceptible to relaxation. The spring maintains the desired compression force without requiring that the size of the contact portion be increased and allows the female terminal to maintain a desired contact area with the male terminal, even when the temperature of the female terminal increases.

It is also known to provide a female terminal with front end protection. An example of front end protection is shown in U.S. Pat. No. 9,548,553. The terminal shown in the '553 patent includes a spring member with integral front end protection. The spring engages contact arms to maintain a compression force between the female terminal and a corresponding male terminal, similar to the spring member described in the '050 patent. Additionally, the spring member includes a cage that extends around and past the contact arms. The cage protects the contact arms from damage during shipping, handling, installation, and use. Because the cage is part of the spring member, no additional pieces are added to the female terminal. It would be desirable to have a spring member that provides a good compression force on the contact member, protection to the contact arms, and is also easier to install.

SUMMARY OF THE INVENTION

The invention relates to an electrical terminal assembly. The electrical terminal assembly includes a contact member. The contact member includes a contact base. A plurality of contact arms extend from the contact base in an arm direction. The contact arms are arranged on opposed sides of a terminal plane. The electrical terminal assembly also includes a spring member. The spring member is supported on the contact member. The spring member includes a spring base. A plurality of spring arms extend from the spring base in the arm direction. The spring arms include respective spring contacts where the spring arms engage one of the contact arms. The spring arms include respective spring deflections between the spring base and the spring contact. Each spring deflection extends into a spring space between adjacent ones of the contact arms.

The invention also relates to a method of assembling an electrical terminal assembly. The method includes positioning a spring member on a contact member so that contact arms of the contact member are engaged by spring arms of the spring member. The method also includes folding a shroud of the spring member so that the shroud extends around and beyond the contact arms.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
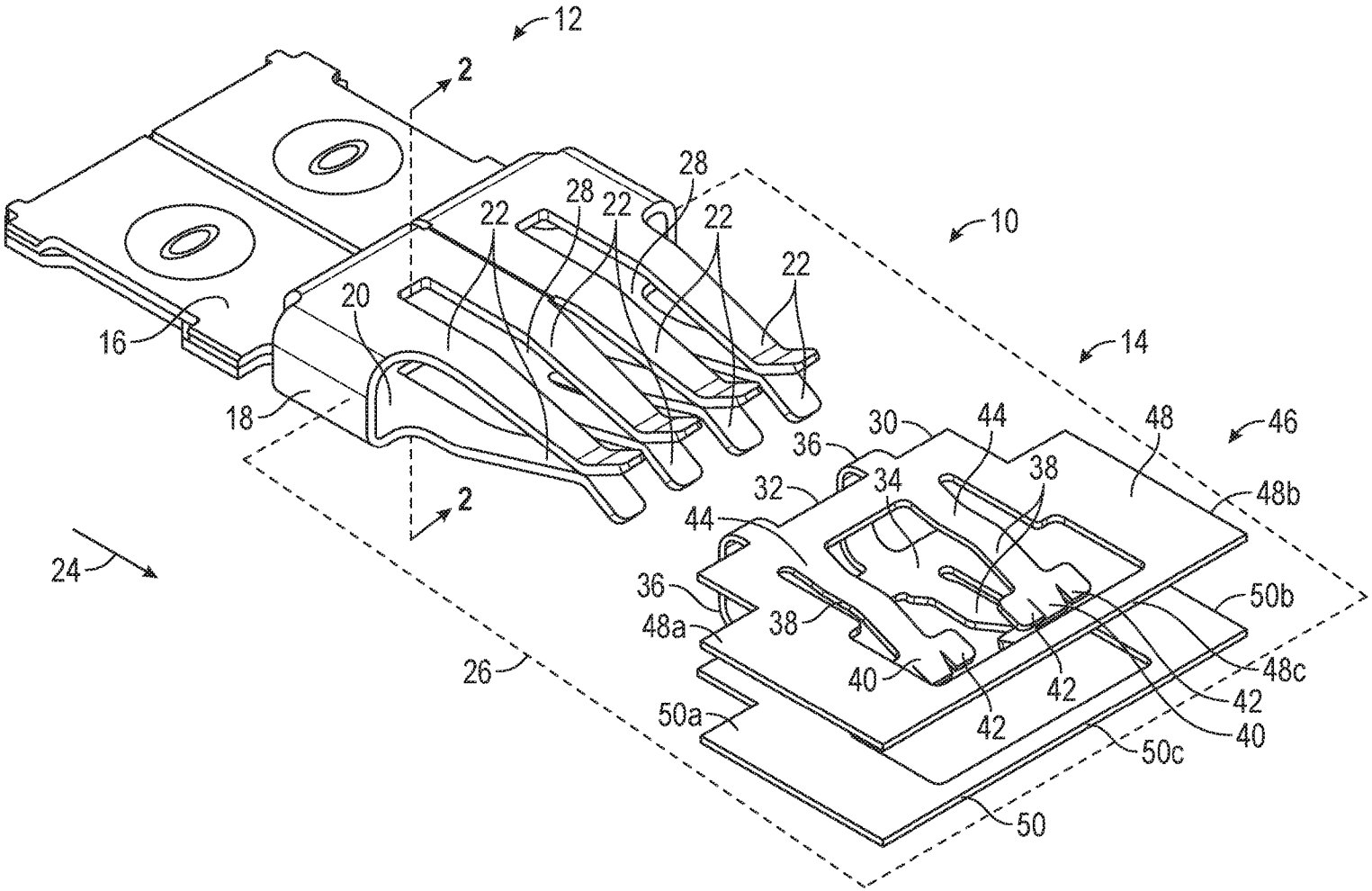
FIG. 1 is an exploded perspective view of a first embodiment of an electrical terminal assembly, shown prior to assembly.

Referring now to the drawings, there are illustrated in FIG. 1 components of a first embodiment of an electrical terminal assembly, indicated generally at 10, in accordance with this invention. The electrical terminal assembly 10 includes a contact member, indicated generally at 12, and a spring member, indicated generally at 14.

The illustrated contact member 12 is made of a single piece of copper, stamped and folded into the illustrated shape. However, the contact member 12 may be made of any desired material, such as aluminum, and may be made by any desired process. The contact member 12 includes a connection portion 16 that is configured to be connected to a conductor such as a wire (not shown). The connection portion 16 may be configured for any desired type of connection. The contact member 12 includes a contact base 18 that is connected to the connection portion 16. The illustrated contact base 18 is a substantially rectangular cross-sectional shaped box that defines an interior space 20. However, the contact base 18 may have any desired shape.

The contact member 12 includes a plurality of contact arms, indicated generally at 22, that extend from the contact base 18 in an arm direction 24. In the illustrated embodiment, the connection portion 16 and the contact arms 22 are located on opposite sides of the contact base 18, but the components may have any desired relative orientations. The contact arms 22 are arranged on opposed sides of a terminal plane 26. In the illustrated embodiment, the contact member 12 includes four pairs of contact arms 22, but the contact member 12 may have any desired number and arrangement of contact arms 22.

The contact member 12 also includes a plurality of spring spaces 28 that are used to position the spring member 14 relative to the contact member 12, as will be described below. The illustrated contact member 12 includes two spring spaces 28 on either side of the terminal plane 26.

However, the contact member 12 may have any desired number of spring spaces 28. In the illustrated embodiment, the spring spaces 28 are located between adjacent contact arms 22 and extend into the contact base 18. However, the spring spaces 28 may be in any desired position on the contact member 12.

The illustrated spring member 14 is made from a single sheet of material, stamped and folded into the illustrated configuration. However, the spring member 14 may be made by any desired process. The illustrated spring member 14 is made of stainless steel, but may be made of any desired material. Preferably, the spring member 14 is made of a material with good spring characteristics even at relatively high temperatures.

The spring member 14 includes a spring base 30. The illustrated spring base 30 includes a first bridge 32 and a second bridge 34 which are each connected to two U-shaped struts 36. However, the spring base 30 may have any desired shape. The spring member 14 includes a plurality of spring arms 38 that extend from the spring base 30 in the arm direction 24. In the illustrated embodiment, the spring member 14 includes two spring arms 38 that extend from the first bridge 32 and two spring arms 38 that extend from the second bridge 34. The spring arms 38 are arranged on opposed sides of the terminal plane 26, with two on either side of the terminal plane 26. However, the spring member 14 may have any desired number and arrangement of spring arms 38.

Each spring arm 38 extends from the spring base 30 to a respective spring end 40. Each spring arm 38 includes spring contacts 42 that engage the contact arms 22 when the electrical terminal assembly 10 is assembled. Each spring arm 38 includes a spring arm deflection 44 between the spring base 30 and the spring contacts 42. Each of the illustrated spring arm deflections 44 is a portion of the respective spring arm 38 that is bent toward the terminal plane 26. The purpose of the spring arm deflections 44 will be described below.

The spring member 14 includes a shroud, indicated generally at 46, which is shown in a pre-assembled position in FIG. 1. The illustrated shroud includes a first shroud portion 48 and a second portion 50 that are located on opposed sides of the terminal plane 26. The illustrated first shroud portion 48 and second shroud portion 50 are mirror images of each other across the terminal plane 26, but may have any desired shapes. Additionally, the shroud 46 may be made from any desired number and arrangement of portions.

The first shroud portion 48 includes a first portion first side 48*a* which is connected to the spring base 30 and extends in the arm direction 24 farther than the spring arms 38. The first shroud portion 48 also includes a first portion second side 48*b* which is connected to the spring base 30 and extends in the arm direction 24 farther than the spring arms 38. The first portion first side 48*a* and the first portion second side 48*b* are located on opposed sides of the spring arms 38 and are each connected to a first end shield 48*c* that is located in the arm direction 24 past the spring arms 38.

The second shroud portion 50 includes a second portion first side 50*a* which is connected to the spring base 30 and extends in the arm direction 24 farther than the spring arms 38. The second portion first side 50*a* is located across the terminal plane 26 from the first portion first side 48*a*. The second shroud portion 50 also includes a second portion second side 50*b* which is connected to the spring base 30 and extends in the arm direction 24 farther than the spring arms 38. The second portion second side 50*b* is located across the terminal plane 26 from the first portion second side 48*b*. The second portion first side 50*a* and the second portion second side 50*b* are located on opposed sides of the spring arms 38 and are each connected to a second end shield 50*c* that is located in the arm direction 24 past the spring arms 38. The second end shield 50*c* is located across the terminal plane 26 from the first end shield 48*c*.

Figure 2:
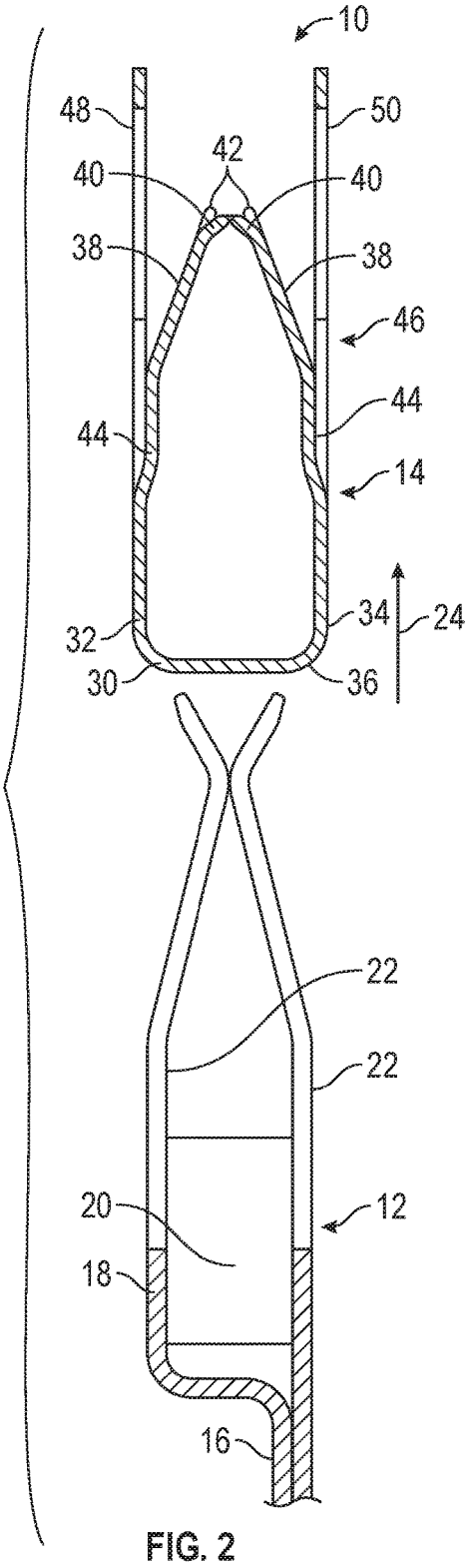
FIG. 2 is a cross-sectional view taken along the line 2-2 of FIG. 1.

Referring to FIG. 2, there is illustrated a cross sectional view taken along the line 2-2 of FIG. 1, which shows the contact member 12 and the spring member 14 prior to assembly. To attach the spring member 14 to the contact member 12, the spring arms 38 are initially pushed away from the terminal plane 26, for example, by an arbor 51 (shown in FIG. 3). When the spring arms 38 are spread apart, the spring member 14 is able to bend along the length of the spring arms 38 and through the spring body 30, including the first bridge 32, the second bridge 34, and the struts 36. The illustrated spring member 14 is symmetrical across the terminal plane 26 and, as a result, the force applied to the spring member 14 and the bending of the spring member 14 is substantially the same on either side of the terminal plane 26 and is neutral at the U-shaped struts 36. The spring arms 38 are moved far enough apart that the contact arms 22 are able to pass between the spring arms 38. In the illustrated embodiment, the contact member 12 is held stationary and the spring member 14 is moved onto the contact member 12.

Figure 3:
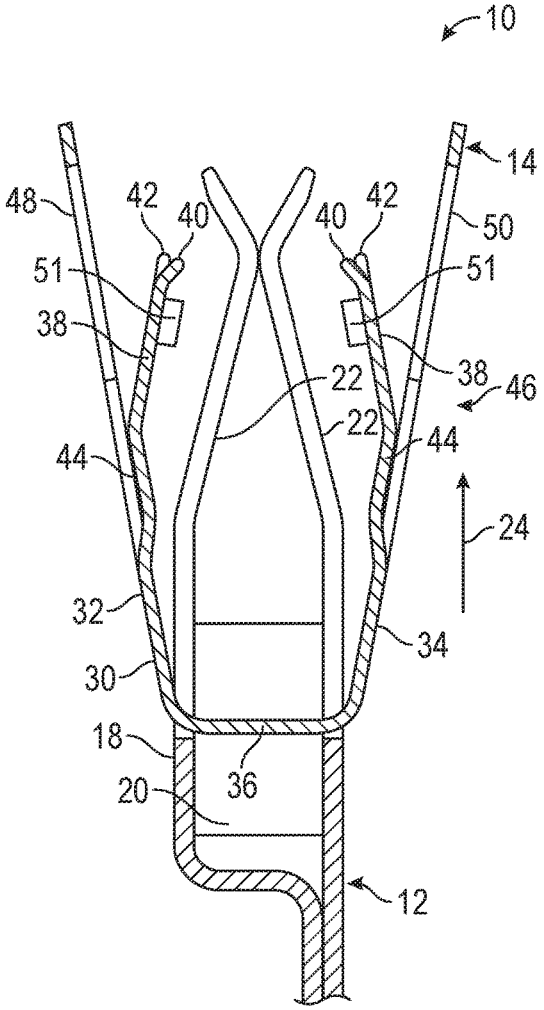
FIG. 3 is a cross-sectional view similar to FIG. 1, showing the electrical terminal assembly during assembly.

Referring to the illustration shown in FIG. 3, the contact member 12 is shown moved in the arm direction 24 relative to the spring member 14 so that the U-shaped struts 36 on the spring member 14 enter the spring spaces 28 on the contact member 12, and the contact arms 22 move past the spring contacts 42. The spring arms 38 are then released so that the spring arms 38 rebound back toward the terminal plane 26 and engage the contact arms 22. The electrical terminal assembly 10 is then in a partially-assembled state illustrated in FIG. 4.

Figure 4:
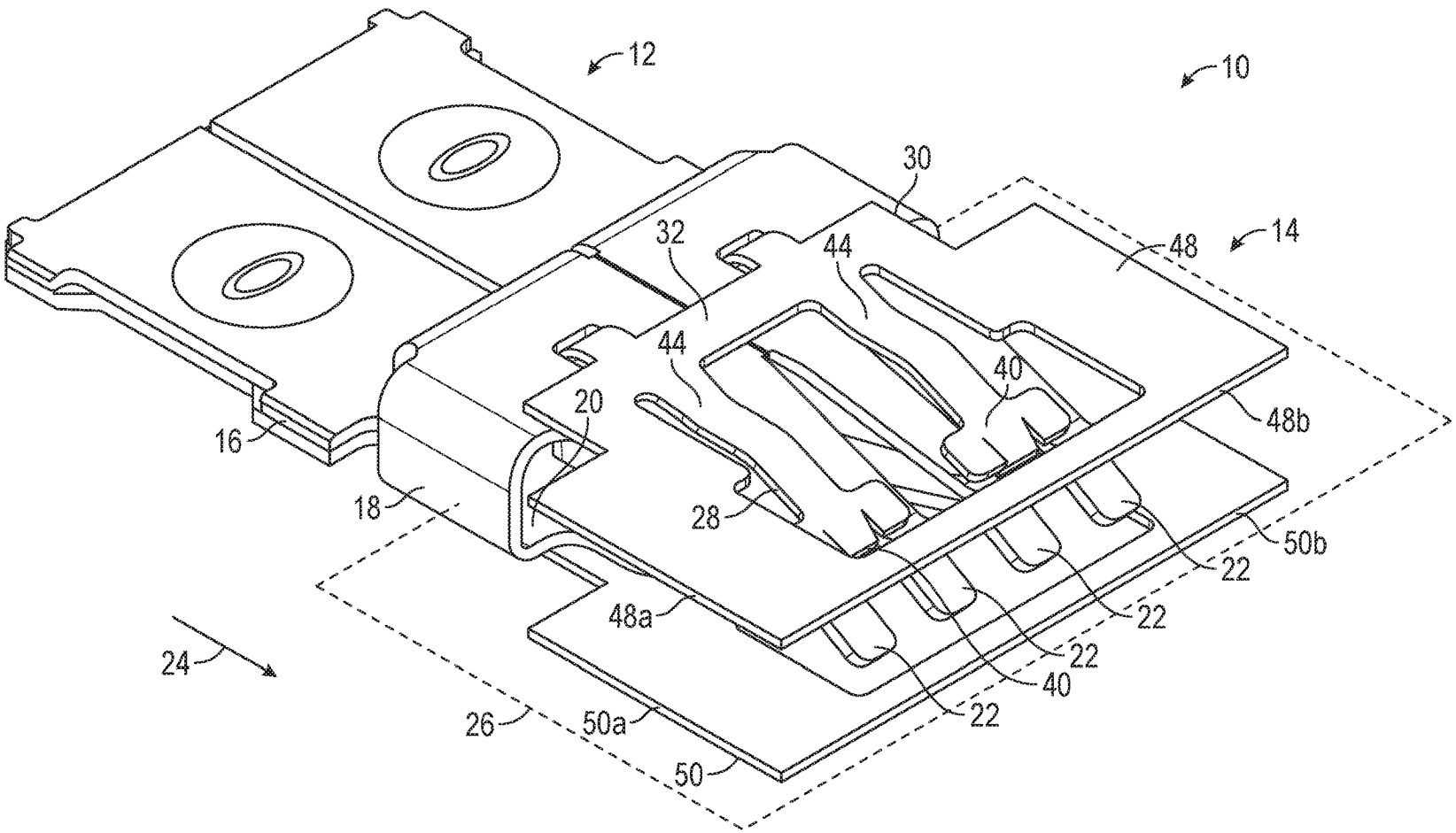
FIG. 4 is a perspective view similar to FIG. 1, showing the electrical terminal assembly partially assembled.

As shown in FIG. 4, the contact member 12 has been moved in the arm direction 24 relative to the spring member 14 so that the struts 36 of the spring member 14 pass through the interior space 20 of the contact member 12. Also, the first bridge 32 and the second bridge 34 (not visible in FIG. 4) are located adjacent the contact body 18, on opposed sides of the contact body 18. In the illustrated embodiment, each spring arm 38 is located between two contact arms 22, and the spring contacts 42 engage those two contact arms 22. However, the spring arms 38 may engage any desired number of contact arms 22. Additionally, the spring arm deflection 44 on each spring arm 38 is located in one of the spring spaces 28 on the contact member 12. This helps to properly position the spring member 14 relative to the contact member 12.

Figure 5:
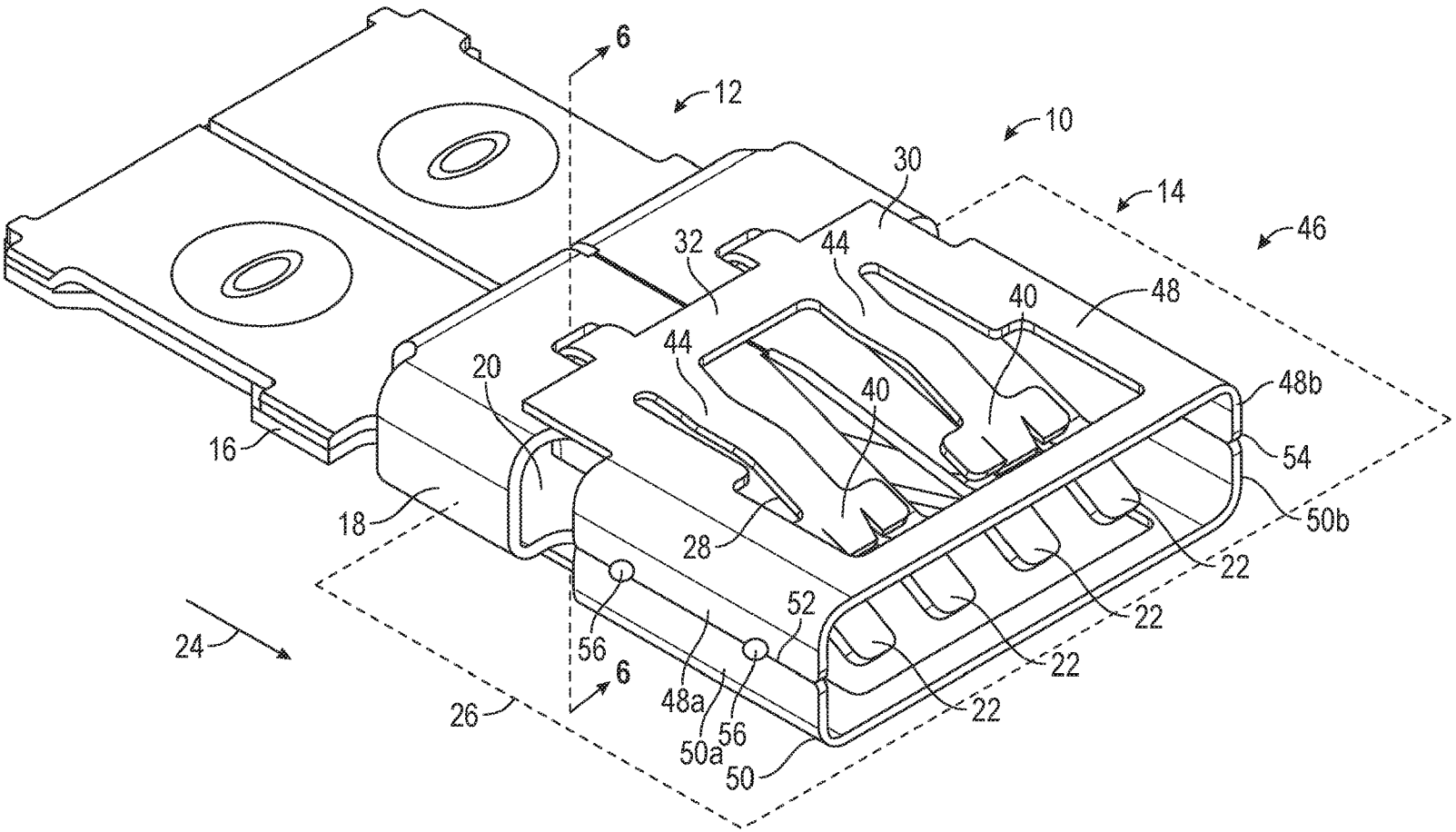
FIG. 5 is a view similar to FIG. 4, showing the electrical terminal assembly fully assembled.

Further assembly of the electrical terminal assembly 10 is shown in FIG. 5. The first portion first side 48*a* is folded toward the terminal plane 26 and the second portion first side 50*a* is folded toward the terminal plane 26 and proximate the first portion first side 48*a*. This creates a first side shield 52 of the shroud 46. Similarly, the first portion second side 48*b* is folded toward the terminal plane 26 and the second portion second side 50*b* is folded toward the terminal plane 26 and proximate the first portion second side 48*b* to create a second side shield 54 of the shroud 46. As previously-described, the spring arm deflection 44 on each spring arm 38 is located in one of the spring spaces 28 on the contact member 12. As should be appreciated from referring to FIGS. 4 and 5, when the shroud 46 is folded to create the first side shield 52 and the second side shield 54, forces are applied to spring member 14 that are perpendicular to the arm direction 24. The spring arm deflections 44 will engage adjacent contact arms 22 to resist movement that may move the spring member 14 out of proper position relative to the contact member 12.

The two side shields 52 and 54 are located on opposed sides of the contact arms 22 and extend beyond and around the contact arms 22. The side shields 52 and 54 prevent inadvertent contact with the contact arms 22 from the sides in order to prevent the contact arms 22 from being damaged during handling or assembly of the electrical terminal assembly 10. Additionally, the first end shield 48*c* and the second end shield 50*c* are located past the contact arms 22 in the arm direction 24 and prevent inadvertent contact with the contact arms 22 from a front end as well as from above or below. The illustrated first shroud portion 48 and the second shroud portion 50 are connected together using welds 56. However, any desired lock or retainer may be used to connect the first shroud portion 48 and the second shroud portion 50.

Figure 6:
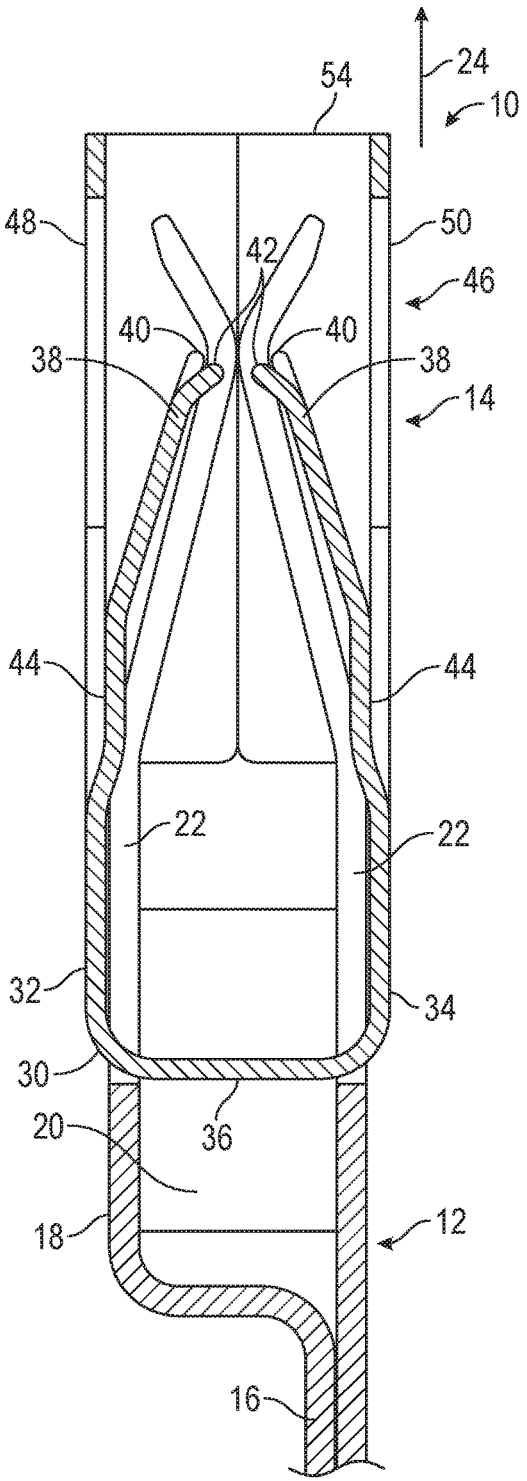
FIG. 6 is a cross-sectional view taken along the line 6 of FIG. 5.
Figure 7:
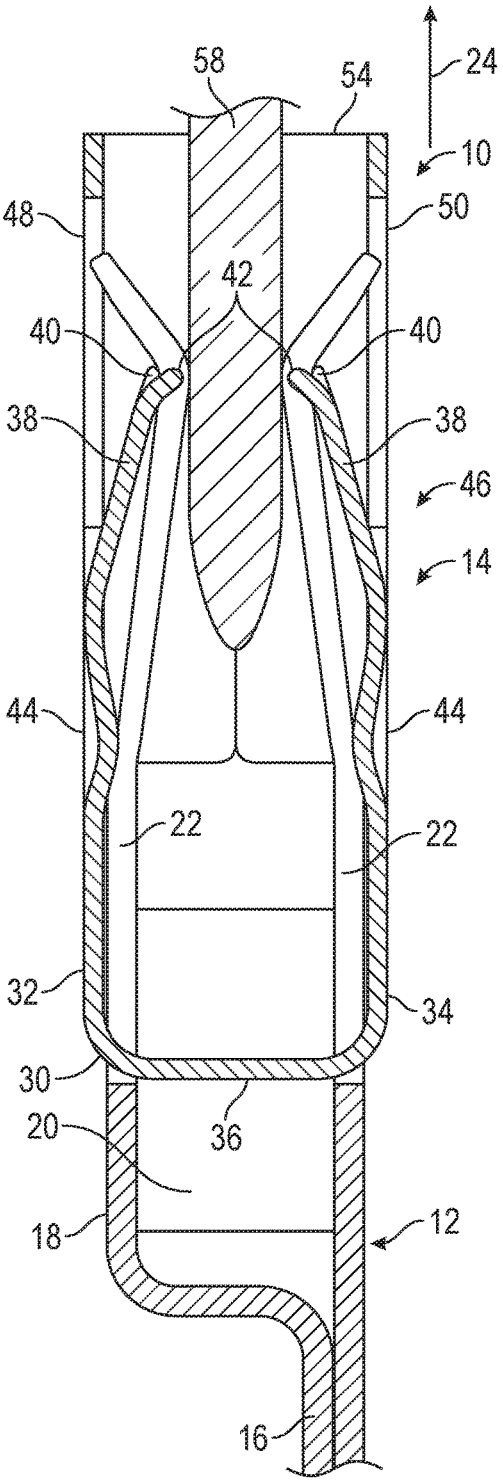
FIG. 7 is a view similar to FIG. 6, showing the electrical terminal assembly mated with a corresponding electrical terminal.

Referring to FIG. 6, a cross-sectional view taken along the line 6 of FIG. 5 is illustrated. This cross-sectional view is similar to FIG. 3, but shows the electrical terminal assembly 10 in its fully assembled state. Referring to FIG. 7, a cross-sectional view similar to FIG. 6 is illustrated, with a corresponding terminal 58 shown partially-mated with the electrical terminal assembly 10. The illustrated corresponding terminal 58 is a blade-type male terminal, but may be any desired type of terminal. In order to mate the two electrical terminals 10 and 58, the corresponding terminal 58 is positioned on the terminal plane 26, and the electrical terminal assembly 10 is moved in the arm direction 24 relative to the corresponding terminal 58. The corresponding terminal 58 engages the contact arms 22 and pushes the contact arms 22 away from the terminal plane 26. Additionally, the spring arms 38, which are engaged with the contact arms 22, are pushed apart, away from the terminal plane 26.

Because the first shroud portion 48 and the second shroud portion 50 are locked together, less of the spring member 14 is able to bend as compared to during the assembly process previously-described and shown in FIG. 3. Referring to FIG. 5, when the first shroud portion 48 and the second shroud portion 50 are connected, these components will not spread apart from each other when the spring arms 38 are pushed apart. Thus, when the electrical terminal 10 is mated with the corresponding terminal, as shown in FIG. 7, the spring arms 38 are able to bend along the length of the spring arms 38 between the respective spring end 40 and the spring body 30. Because less of the spring member 14 is able to bend during mating, the amount of force required to push the spring arms 38 apart is greater during mating as compared to during assembly. This allows the spring member 14 to be relatively easy to assemble, while provided a relatively large engagement force during mating.

As previously described, the illustrated spring arms 38 include spring arm deflections 44. The spring arm deflections 44 increase the overall length of the spring arms 38 between the respective spring end 40 and the spring body 30. This reduces the amount of stress experienced by the spring arms 38 when they are pushed apart during engagement of the electrical terminal assembly 10 with corresponding terminal 58. As the spring arms 38 are pushed apart, they will typically move through a range of elastic deformation from which the spring arms 38 will rebound. If the spring arms 38 are pushed too far apart, they may be subject to plastic deformation which will alter the shape of the spring arms 38. By increasing the overall length of the spring arms 38, the spring arms 38 are less likely to be plastically deformed when pushed apart. This allows the electrical terminal assembly 10 to be used with a variety of corresponding terminals (not shown) having greater thicknesses.

As also shown in FIG. 7, when the electrical terminal assembly 10 is mated with the corresponding electrical terminal 58, the spring arms 38 are pushed away from the terminal plane 26 but remain inside the shroud 46. The spring arms 38 do not move farther from the terminal plane 26 than does the shroud 46. By maintaining the spring arms 38 inside the shroud 46, the electrical terminal assembly 10 may be used in a housing (not shown) that is not any larger than the shroud 46.

Figure 8:
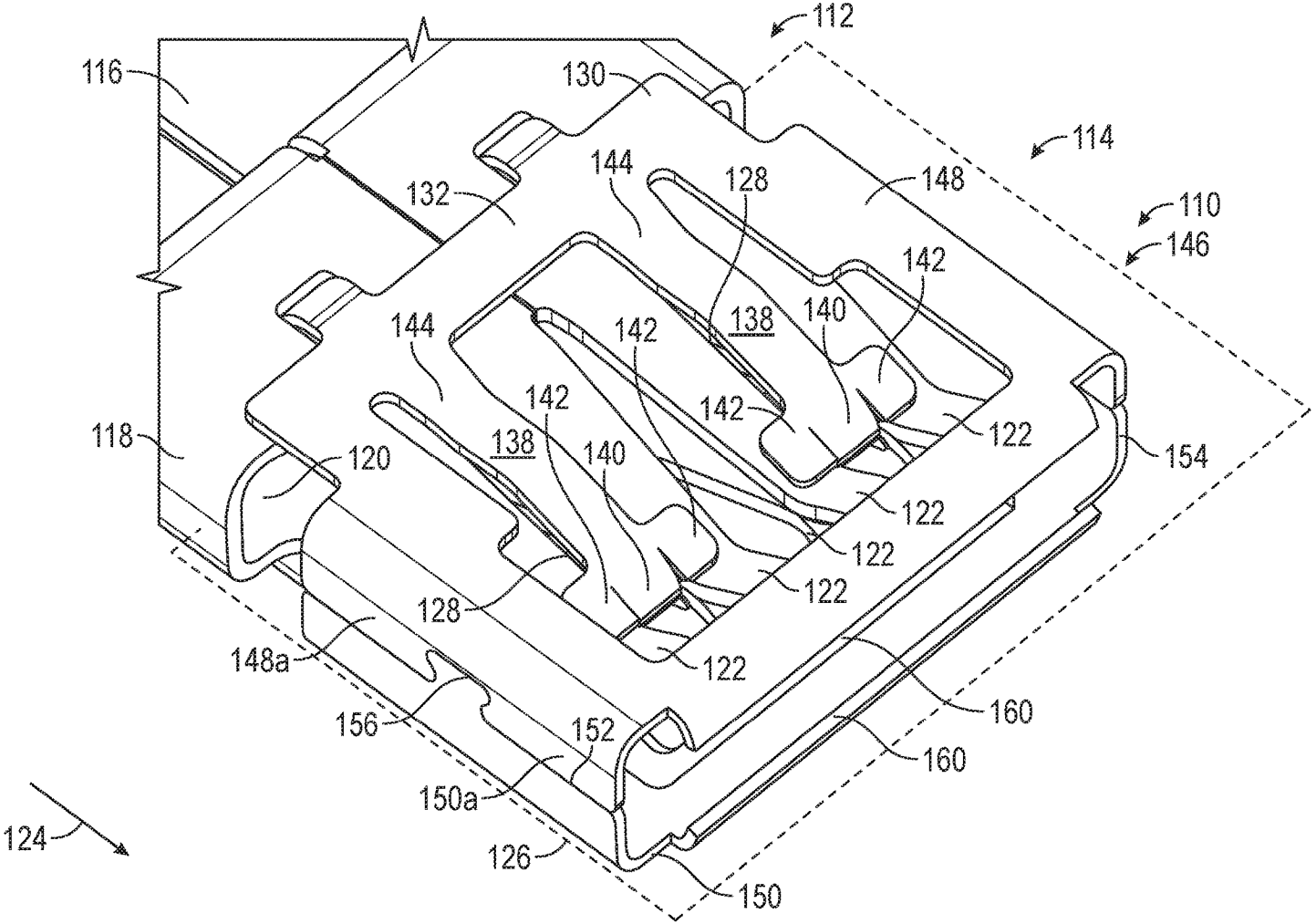
FIG. 8 is an enlarged, perspective view of a portion of a second embodiment of an electrical terminal assembly.

Referring to FIG. 8, an enlarged, perspective view of a portion of an alternative embodiment of an electrical terminal assembly, indicated generally at 110, in accordance with this invention is illustrated. The electrical terminal assembly 110 is substantially the same as the previously-described electrical terminal assembly 10 and similar features on the electrical terminal assembly 110 are identified by the same reference number increased by 100. The electrical terminal assembly 110 will not be described in detail, and only those features that differ from the electrical terminal assembly 10 will be described. The electrical terminal assembly 110 includes a dovetail lock 156 on a first side shield 152 that holds a first shroud portion 148 and a second shroud portion 150 together. The dovetail lock 156 replaces the weld 56 on the electrical terminal assembly 10. The electrical terminal assembly 110 includes a second dovetail lock (not shown) on a second side shield 154, which is not visible in FIG. 8. Additionally, the electrical terminal assembly 110 includes outwardly-extending terminal guides 160 that extend from a shroud 146. The terminal guides 160 serve to help protect contact arms 122 from damage during mating with a corresponding terminal (not shown).

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal assembly comprising:

a contact member including a contact base and a plurality of contact arms extending from the contact base in an arm direction and arranged on opposed sides of a terminal plane; and a spring member supported on the contact member and including (1) a spring base, (2) a plurality of spring arms that extend from the spring base in the arm direction, are arranged on opposed sides of the terminal plane, and engage the plurality of contact arms at respective spring contacts, and (3) a shroud that is connected to the spring base and extends around the contact arms and beyond the contact arms in the arm direction.

2. The electrical terminal assembly of claim 1, wherein the spring member is symmetrical across the terminal plane.

3. The electrical terminal assembly of claim 1, wherein each of the plurality of spring arms includes a spring arm deflection that is located between the spring base and the respective spring contact and that extends into a spring space defined between adjacent ones of the plurality of contact arms.

4. The electrical terminal assembly of claim 3, wherein each of the spring arm deflections is bent toward the terminal plane.

5. The electrical terminal assembly of claim 4, wherein each of the spring arm deflections is also bent away from the terminal plane.

6. The electrical terminal assembly of claim 1, wherein the shroud includes a first shroud portion and a second shroud portion that extend around the plurality of contact arms and are connected together.

7. The electrical terminal assembly of claim 6, wherein the first shroud portion includes a first portion first side and a first portion second side, the second shroud portion includes a second portion first side and a second portion second side, the first portion first side is connected to the second portion first side, and the first portion second side is connected to the second portion second side.

8. The electrical terminal assembly of claim 6, wherein the first shroud portion and the second shroud portion are connected together by a weld.

9. The electrical terminal assembly of claim 6, wherein the first shroud portion and the second shroud portion are connected together by a dovetail lock.

10. The electrical terminal assembly of claim 6, wherein the first shroud portion and the second shroud portion are located on opposed sides of the terminal plane.

11. The electrical terminal assembly of claim 6, wherein the first shroud portion includes a first end shield that extends in the arm direction past the plurality of spring arms, and the second shroud portion includes a second end shield that extends in the arm direction past the plurality of spring arms.

12. The electrical terminal assembly of claim 6, wherein:

the first shroud portion includes a first portion first side, a first portion second side, and a first end shield that extends in the arm direction past the plurality of spring arms;

the second shroud portion includes a second portion first side, a second portion second side, and a second end shield that extends in the arm direction past the plurality of spring arms;

the first portion first side is connected to the second portion first side, and the first portion second side is connected to the second portion second side.

* * * * *